US005311806A

United States Patent [19]

Riboloff

[11] Patent Number: 5,311,806

[45] Date of Patent: May 17, 1994

[54] GUITAR PICKUP SYSTEM FOR SELECTING FROM MULTIPLE TONALITIES

[75] Inventor: John T. Riboloff, Antioch, Tenn.

[73] Assignee: Gibson Guitar Corp., Nashville, Tenn.

[21] Appl. No.: 3,983

[22] Filed: Jan. 15, 1993

[51] Int. Cl.[5] ..... G10H 3/18

[52] U.S. Cl. ..... 84/728; 84/742

[58] Field of Search ..... 84/726-728, 84/742

[56] References Cited

U.S. PATENT DOCUMENTS

| | | |
|---|---|---|
| 2,784,631 | 3/1957 | Fender . |
| 3,073,202 | 1/1963 | Evans . |
| 3,478,158 | 11/1969 | Trainor . |
| 3,544,696 | 12/1970 | Broussard . |
| 3,915,048 | 10/1975 | Stich . |
| 4,010,668 | 3/1977 | Plueddemann . |
| 4,024,789 | 5/1977 | Humphrey et al. . |
| 4,151,776 | 5/1979 | Stich . |
| 4,164,163 | 8/1979 | Rhodes . |
| 4,175,462 | 11/1979 | Simon . |
| 4,222,301 | 9/1980 | Valdez . |
| 4,245,540 | 1/1981 | Groupp . |
| 4,305,320 | 12/1981 | Peavey . |
| 4,319,510 | 3/1982 | Fender . |
| 4,331,060 | 5/1982 | Allen . |
| 4,379,421 | 4/1983 | Nunan . |
| 4,408,513 | 10/1983 | Clevinger . |
| 4,418,599 | 12/1983 | Raskin . |
| 4,419,916 | 12/1983 | Aoki . |
| 4,480,520 | 11/1984 | Gold . |
| 4,481,854 | 11/1984 | Dugas . |
| 4,545,278 | 10/1985 | Gagon et al. . |
| 4,580,480 | 4/1986 | Turner . |
| 4,581,974 | 4/1986 | Fender . |
| 4,581,975 | 4/1986 | Fender . |
| 4,632,002 | 12/1986 | Clevinger . |
| 4,711,149 | 12/1987 | Starr . |
| 4,817,486 | 4/1989 | Saunders . |
| 4,907,483 | 3/1990 | Rose et al. . |
| 4,913,024 | 4/1990 | Carriveau . |
| 5,136,918 | 8/1992 | Riboloff . |
| 5,136,919 | 8/1992 | Wolstein . |

*Primary Examiner*—Stanley J. Witkowski

*Attorney, Agent, or Firm*—Dougherty, Hessin, Beavers & Gilbert

[57] ABSTRACT

A switching system for an electric guitar using bridge and fingerboard humbucker pickups and an intermediate pickup provides for ready selection of distinct groups of Gibson tonalities and Fender tonalities. A four pole, five position switch for tone selection provides one-of-ten tonality selection in conjunction with a dual pole, double throw switch.

3 Claims, 1 Drawing Sheet

GUITAR PICKUP SYSTEM FOR SELECTING FROM MULTIPLE TONALITIES

BACKGROUND OF THE INVENTION

This invention relates generally to variable tone electric guitars and more particularly, but not by way of limitation, to an improved switching system for interchanging the selection and combination of pickup outputs to provide a wide variety of output sounds.

There are two general electric guitar sounds prevalent in the music industry today: the Gibson tonality and the Fender tonality. The Gibson tonality, such as exemplified in the LES PAUL guitar, is obtained from either or both of two dual coil hum-canceling pickups referred to herein as humbucker pickups. The Fender tonality, such as exemplified in the STRATOCASTER or TELECASTER guitars, is obtained from selected combinations of three single coil pickups.

A switching system by which either a Gibson tonality or a Fender tonality can be obtained from a single electric guitar is disclosed in U.S. Pat. No. 5,136,918 to Riboloff, which patent is incorporated herein by reference. The preferred embodiment system of the Riboloff patent uses two dual coil humbucker pickups and one single coil pickup and switching devices to allow a player to select one of at least three Gibson tonalities associated with the LES PAUL guitar or one of five Fender tonalities associated with the STRATOCASTER guitar.

SUMMARY OF THE INVENTION

The present invention is a modification of the system disclosed in the aforementioned Riboloff patent. The present invention makes additional tonalities available to the player, and the present invention makes independent pole-terminal connections from one discrete terminal to another.

The present invention provides a guitar pickup system, comprising: a dual coil bridge humbucker pickup; an intermediate pickup; a dual coil fingerboard humbucker pickup; first switch means for selecting a desired pickup configuration and thereby selecting a desired tonality signal, which first switch means includes a four pole, five position switch connected to the bridge humbucker pickup, the intermediate pickup and the fingerboard humbucker pickup so that any of a first set of five tonality signals is selected through first and second poles of the first switch means and so that any of a second set of five tonality signals is selected through third and fourth poles of the first switch means; and second switch means for connecting to an output of the second switch means either the tonality signal selected through the first and second poles of the first switch means or the tonality signal selected through the third and fourth poles of the first switch means.

Therefore, from the foregoing, it is a general object of the present invention to provide a novel and improved guitar pickup switching system. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENTS

U.S. Pat. No. 5,136,918 to Riboloff is incorporated herein by reference.

Figure 1:
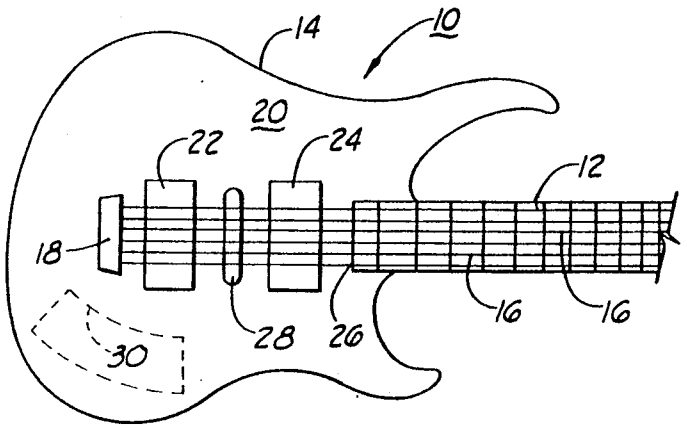
FIG. 1 is a plan view of a guitar body showing the layout of three pickups used in the system of the present invention.

Referring to FIG. 1, which is the same in both the present disclosure and the Riboloff '918 patent, a guitar 10 is shown with a portion of a neck 12 secured to a main body 14. The guitar 10 includes guitar strings 16 as secured to a bridge 18 and tuning screws (not shown) as known in the art.

Figure 2:
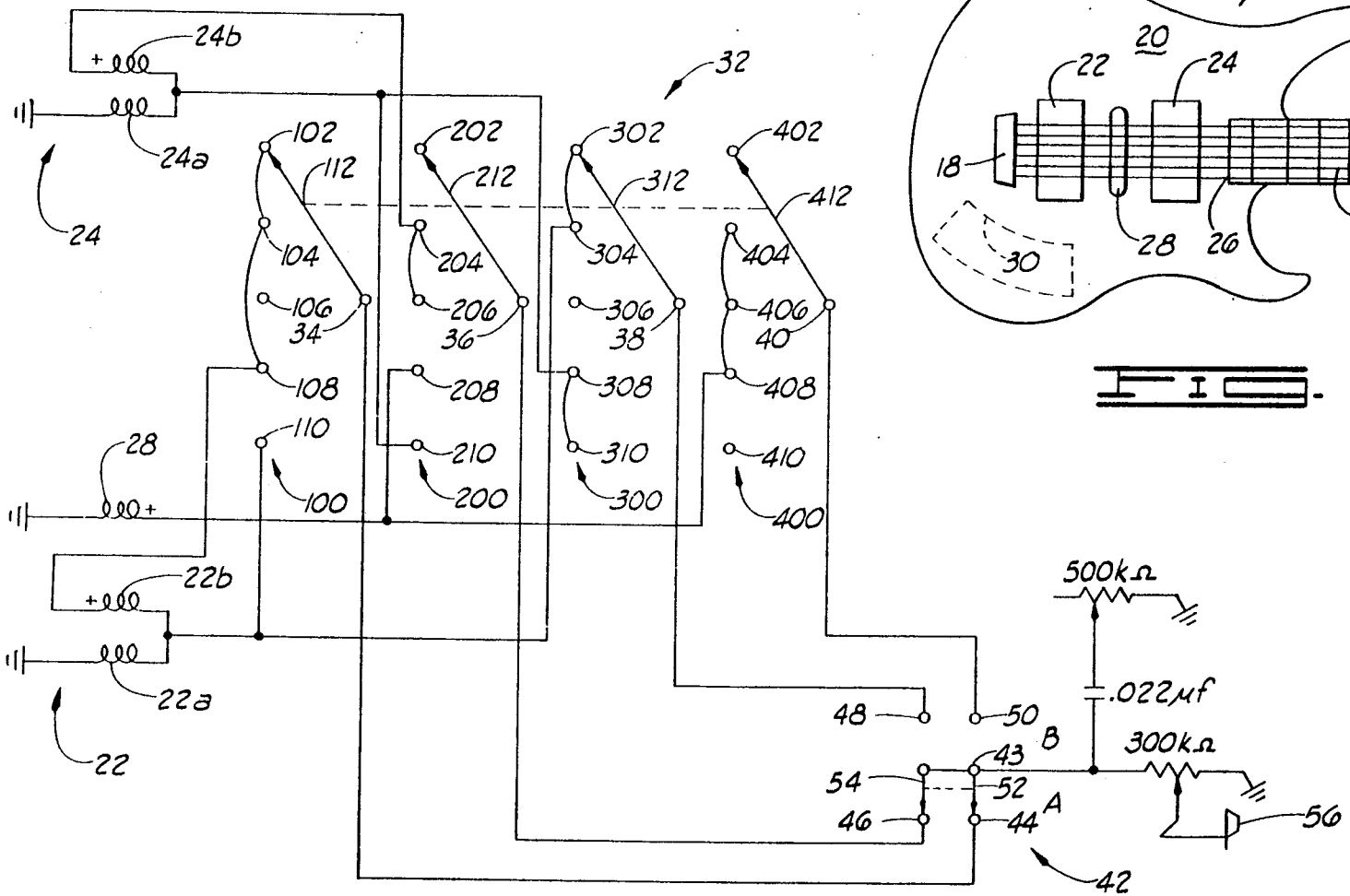
FIG. 2 is a schematic diagram of the preferred embodiment guitar switching system of the present invention.

Three pickups are arrayed beneath strings 16 and secured to a face 20 of the main body 14 in conventional manner. A treble dual coil humbucker pickup 22 (having coils 22*a*, 22*b* as shown in FIG. 2) is secured transversely beneath strings 16 and close to the bridge 18, a position known as the "bridge pickup." In similar manner, a rhythm dual coil humbucker pickup 24 (having coils 24*a*, 24*b* as shown in FIG. 2) is secured in spaced, parallel relationship closely adjacent an end 26 of the fingerboard 12, and this type of pickup is known as the "fingerboard pickup." A single coil intermediate or middle pickup 28 is secured intermediate the positions of the dual coil pickups 22, 24, but a humbucker pickup (or functionally at least one coil thereof) can also be utilized in the center position.

To obtain from the aforementioned pickups the tonalities made available by the present invention, the present invention further includes switch mechanisms that will typically be located in or near an area 30 of the face 20 of the main body 14 of the guitar 10. The switch mechanisms and their connections to the pickups 22, 24, 28 for the preferred embodiment are shown in FIG. 2.

A switch 32 is used for selecting a desired pickup configuration and thereby selecting a desired tonality signal. The switch 32 of the preferred embodiment is a four pole, five position switch connected to the bridge humbucker pickup 22, the intermediate pickup 28 and the fingerboard humbucker pickup 24 so that any of a first set of five tonality signals is selected through first and second poles 34, 36 of the switch 32 and so that any of a second set of five tonality signals is selected through third and fourth poles 38, 40 of the switch 32.

The switch 32 has a first set 100 of first through fifth terminals 102, 104, 106, 108, 110. The first terminal 102, the second terminal 104 and the fourth terminal 108 are connected to an end of the bridge humbucker pickup 22 opposite the end of the pickup connected to electrical ground as shown in FIG. 2. That is, these switch terminals are connected in common with the end of the coil 22*b* not connected to the coil 22*a*. The fifth terminal 110 is connected in between the dual coils of the bridge humbucker pickup 22 (i.e., to the junction of the coils 22*a*, 22*b*). The third terminal 106 is unconnected or open.

The switch 32 has a second set 200 of first through fifth terminals 202, 204, 206, 208, 210. The second and third terminals 204, 206 are connected to an end of the fingerboard humbucker pickup 24 opposite the end thereof connected to electrical ground. In particular, the terminals 204, 206 are connected to the end of the coil 24*b* opposite the end connected to the coil 24*a* as shown in FIG. 2. The fourth terminal 208 is connected to the intermediate pickup 28 opposite the end of that pickup which is connected to electrical ground. The fifth terminal 210 is connected in between the dual coils of the fingerboard humbucker pickup 24 (i.e., to the junction of the coils 24*a*, 24*b*). The first terminal 202 is unconnected or open.

The switch 32 has a third set 300 of first through fifth terminals 302, 304, 306, 308, 310. The first and second terminals 302, 304 are connected in between the dual coils 22*a*, 22*b* of the bridge humbucker pickup 22 (i.e., to the junction between these two coils). The fourth and fifth terminals 308, 310 are connected in between the dual coils 24*a*, 24*b* of the fingerboard humbucker pickup 24 (i.e., to the junction between these two coils). The third terminal 306 is unconnected or open.

The switch 32 has a fourth set 400 of first through fifth terminals 402, 404, 406, 408, 410. The second terminal 404, the third terminal 406 and the fourth terminal 408 are connected to the intermediate pickup 28 opposite the end thereof connected to electrical ground. The first terminal 402 and the fifth terminal 410 are unconnected or open.

The switch 32 further includes: a connector 112 for connecting a selected terminal of the first set 100 to the pole 34; a connector 212 for connecting a selected terminal of the second set 200 to the pole 36; a connector 312 for connecting a selected terminal of the third set 300 to the pole 38; and a connector 412 for connecting a selected terminal of the fourth set 400 to the pole 40. The switch 32 also includes means for synchronously operating the connectors 112, 212, 312, 412 so that the corresponding terminal of each set of terminals is connected to its respective pole at the same time. In the preferred embodiment, this is implemented by mechanically ganging four wiper arms implementing the connectors 112, 212, 312, 412 as represented in FIG. 2. The end of a single crankshaft to which the wiper arms are connected protrudes from the face 20 of the guitar's main body 14 to allow the player to rotate through the five positions of the switch 32 and simultaneously connect each wiper arm to the same respective terminal of the respective set (e.g., connector 112 to terminal 102, connector 212 to terminal 202, connector 312 to terminal 302, and connector 412 to terminal 402).

In a particular implementation, the switch 32 is implemented with a commercially available mechanical four pole, five position rotary switch from Standard Griggsby, wherein each terminal of the sets 100, 200, 300, 400 is separate and distinct and the respective connector 112, 212, 312, 412 makes contact with only a single terminal of its respective set at any one time, thereby providing a simple, positive connection at each selected position. It is contemplated, however, that other types of switches can be used, whether mechanical or non-mechanical (e.g., a non-mechanical switch such as a solid state switch providing the same functions as described above).

The present invention also comprises a switch 42 for connecting to its output 43 either the tonality signal selected through the poles 34, 36 of the switch 32 or the tonality signal selected through the poles 38, 40 of the switch 32. The switch 42 comprises: a terminal 44 connected to the pole 34 of the switch 32; a terminal 46 connected to the pole 36 of the switch 32; a terminal 48 connected to the pole 38 of the switch 32; a terminal 50 connected to the pole 40 of the switch 32; and means for selectably connecting either both terminals 44, 46 to the output of the switch 42 or both terminals 48, 50 to the output of the switch 42. Such means is illustrated in FIG. 2 by ganged, electrically connected wiper arms 52, 54 movable between position A where they contact terminals 44, 46, respectively, and position B where they contact terminals 50, 48, respectively. Particular implementations of the switch 42 include a mechanical toggle switch or a push-pull potentiometer switch, but it is contemplated that other implementations can be used.

With the switch 42 in position or mode A, multiple electrical signals provided when more than one pickup is selected through connectors 112, 212 are combined into one tonality signal because of the common communication of the electrical signals to the single output 43 of the switch 42. The same applies when the switch is in position or mode B with regard to more than one pickup being selected through connectors 312, 412. Of course, if only one pickup is selected, its electrical signal is communicated to the output 43 when the switch 42 is in the appropriate mode. The output signal from the switch 42 is communicated through an output jack 56 to which an amplifier (not shown) can be connected as known in the art. The jack 56 is shown in FIG. 2 connected to the output of the switch 42 through a resistor-capacitor network of known type.

With the switch 42 in position A, the following selections are made by operating the switch 32 of the preferred embodiment:

| Position | Selection |
|---|---|
| 102/202 | Bridge pickup 22, both coils |
| 104/204 | Pickups 22 and 24, four coils |
| 106/206 | Fingerboard pickup 24, both coils |
| 108/208 | Pickups 22 and 28, three coils |
| 110/210 | Pickups 22 and 24 split, two coils |

The first three positions referred to in the above table are the same as the first three positions for mode A in the Riboloff '918 patent and produce a Gibson tonality of the type particularly identified with the LES PAUL guitar. The fourth position referred to in the above table provides a sound different from those specifically referenced in the Riboloff patent and different from the conventional Gibson and Fender sounds. The fifth position referred to in the above table produces a Fender tonality of the type particularly identified with the TELECASTER guitar.

With the switch 42 in position B, the following selections are made by operating the switch 32:

| Position | Selection |
|---|---|
| 302/402 | Bridge pickup 22 split, one coil |
| 304/404 | Pickup 22 split and pickup 28, two coils |
| 306/406 | Intermediate pickup 28, one coil |
| 308/408 | Pickup 24 split and pickup 28, two coils |
| 310/410 | Fingerboard pickup 24 split, one coil |

Each of these selections corresponds to the selections that can be made during the mode B operation disclosed in the Riboloff '918 patent. Each of these selections produces a sound characteristic of the Fender STRATOCASTER guitar (the sounds from the first and fifth positions are also associated with the TELECASTER guitar).

With the above-described embodiment, any one of ten tonalities can be selected through the simple procedure of selecting mode A or B via the switch 42 and the specific tonality via the switch 32.

Thus, the present invention is well adapted to carry out the objects and attain the ends and advantages mentioned above as well as those inherent therein. While a preferred embodiment of the invention has been described for the purpose of this disclosure, changes in the construction and arrangement of parts can be made by those skilled in the art, which changes are encompassed within the spirit of this invention as defined by the appended claims.

What is claimed is:

1. A guitar pickup system, comprising:

a dual coil bridge humbucker pickup;

an intermediate pickup;

a dual coil fingerboard humbucker pickup;

first switch means for selecting a desired pickup configuration and thereby selecting a desired tonality signal, said first switch means including a four pole, five position switch connected to said bridge humbucker pickup, said intermediate pickup and said fingerboard humbucker pickup so that any of a first set of five tonality signals is selected through first and second poles of said first switch means and so that any of a second set of five tonality signals is selected through third and fourth poles of said first switch means; and second switch means for connecting to an output of said second switch means either the tonality signal selected through said first and second poles of said first switch means or the tonality signal selected through said third and fourth poles of said first switch means.

2. A guitar pickup system as defined in claim 1, wherein said four pole, five position switch further includes:

a first set of first through fifth terminals wherein the first, second and fourth terminals thereof are connected to an end of said bridge humbucker pickup and the fifth terminal thereof is connected in between the dual coils of said bridge humbucker pickup;

a second set of first through fifth terminals wherein the second and third terminals thereof are connected to an end of said fingerboard humbucker pickup, the fourth terminal thereof is connected to said intermediate pickup, and the fifth terminal thereof is connected in between the dual coils of said fingerboard humbucker pickup;

a third set of first through fifth terminals wherein the first and second terminals thereof are connected in between the dual coils of said bridge humbucker pickup and the fourth and fifth terminals thereof are connected in between the dual coils of said fingerboard humbucker pickup;

a fourth set of first through fifth terminals wherein the second, third and fourth terminals thereof are connected to the intermediate pickup;

first connector means for connecting a selected terminal of said first set to said first pole;

second connector means for connecting a selected terminal of said second set to said second pole;

third connector means for connecting a selected terminal of said third set to said third pole;

fourth connector means for connecting a selected terminal of said fourth set to said fourth pole; and means for synchronously operating said first through fourth connector means so that the corresponding terminal of each set of terminals is connected to its respective pole at the same time.

3. A guitar pickup system as defined in claim 2, wherein said second switch means includes:

a first terminal connected to said first pole of said first switch means;

a second terminal connected to said second pole of said first switch means;

a third terminal connected to said third pole of said first switch means;

a fourth terminal connected to said fourth pole of said first switch means; and means for selectably connecting either both said first and second terminals of said second switch means to said output thereof or both said third and fourth terminals of said second switch means to said output thereof.

* * * * *